US010074943B2

(12) United States Patent
Lappoehn

(10) Patent No.: US 10,074,943 B2
(45) Date of Patent: Sep. 11, 2018

(54) PLUG DEVICE

(71) Applicant: ERNI Production GmbH & Co. KG, Adelberg (DE)

(72) Inventor: Juergen Lappoehn, Gammelhausen (DE)

(73) Assignee: ERNI Production GmbH & Co. KG, Adelberg (DE)

( * ) Notice: Subject to any disclaimer, the term of this patent is extended or adjusted under 35 U.S.C. 154(b) by 0 days.

(21) Appl. No.: 15/554,298

(22) PCT Filed: Apr. 12, 2016

(86) PCT No.: PCT/DE2016/100169
§ 371 (c)(1),
(2) Date: Aug. 29, 2017

(87) PCT Pub. No.: WO2016/165689
PCT Pub. Date: Oct. 20, 2016

(65) Prior Publication Data

US 2018/0054029 A1 Feb. 22, 2018

(30) Foreign Application Priority Data

Apr. 16, 2015 (DE) ..... 10 2015 105 852

(51) Int. Cl.
*H01R 13/6585* (2011.01)
*H01R 13/66* (2006.01)
(Continued)

(52) U.S. Cl.
CPC ..... *H01R 13/6616* (2013.01); *H01R 13/03* (2013.01); *H01R 13/2492* (2013.01); *H01R 13/6587* (2013.01)

(58) Field of Classification Search
CPC ..... H01R 13/6585; H01R 13/6616; H01R 3/688; H01R 23/6873; H01R 23/7073; H01R 23/688
(Continued)

(56) References Cited

U.S. PATENT DOCUMENTS 5,228,871 A 7/1993 Goodman
6,102,742 A * 8/2000 Daly ..... H01R 13/6616 338/21
(Continued)

FOREIGN PATENT DOCUMENTS

DE 42 22 452 A1 1/1993
DE 197 27 092 A1 1/1998
(Continued)

OTHER PUBLICATIONS

Meinke and Gundlach, "Taschenbuch für Hochfrequenztechnik" (Pocket book for high-frequency technology), Springer-Verlag 1956, pp. 6-15, 48-49, and 158-169 (27 pages).
International Search Report of PCT/DE2016/100169, dated Aug. 22, 2016.

*Primary Examiner* — Gary Paumen
(74) *Attorney, Agent, or Firm* — Collard & Roe, P.C.

(57) ABSTRACT

The invention relates to a plug device (10) which contains a first plug connector (12) having spring contacts (16), wherein at least one spring contact (16) is provided for the establishing of an electrical connection between a first and a second electrical circuit ground (18*a*, 18*b*), and which contains a second plug connector (14) having blade contacts (28), wherein at least one blade contact (28) is provided for the establishing of the connection of the two electrical circuit grounds (18*a*, 18*b*). The plug device (10) according to the invention is characterized by an ohmic resistor (34) being provided at least in one partial region (42) at the contact point (30, 40) at which the front end (36, 38) of at
(Continued)

Figure 1:
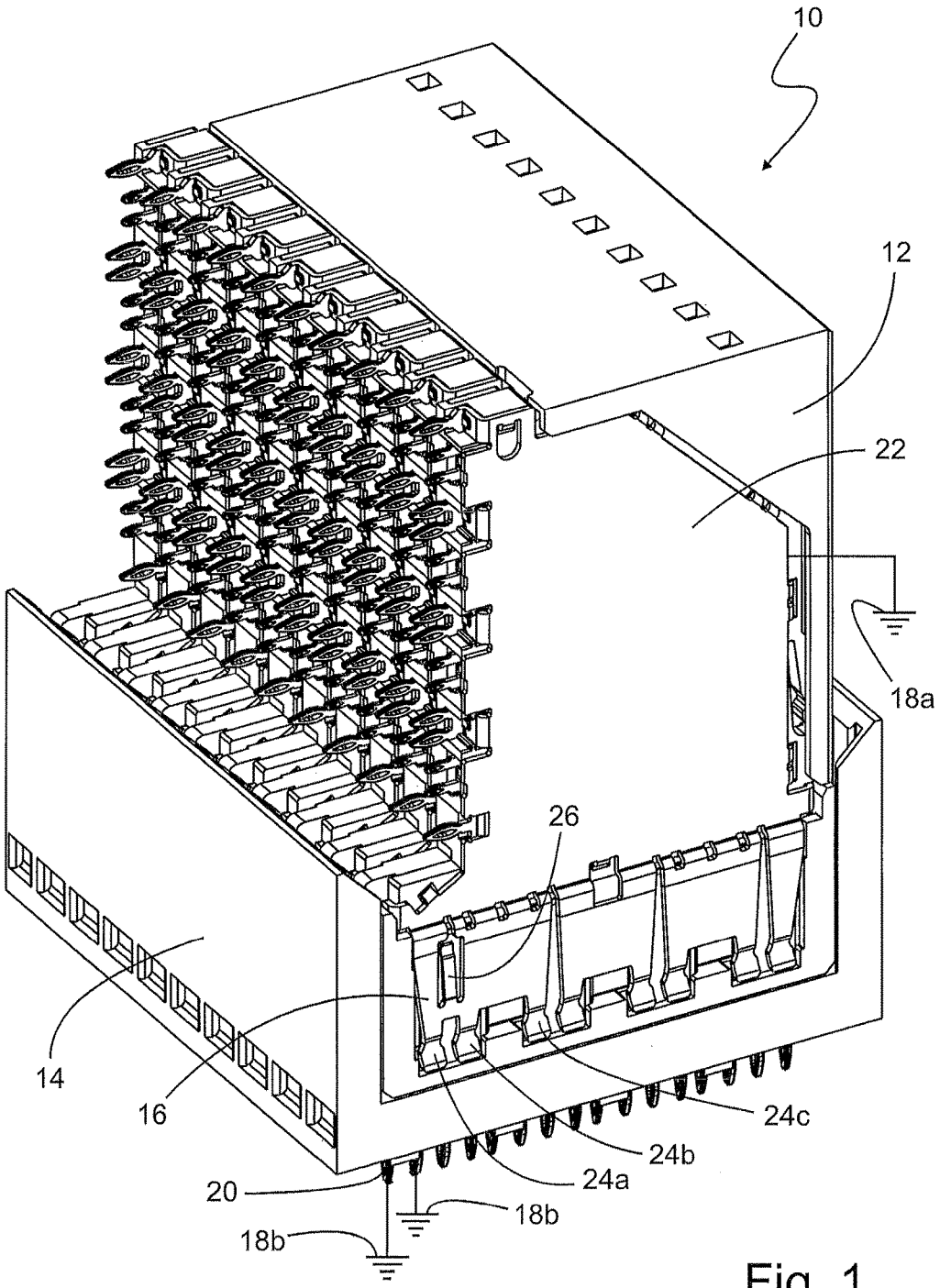

least one spring element (24*a,* 24*b,* 24*c,* 26) of a spring contact (16) of the first plug connector (12) is born on a blade contact (28) of the second plug connector (14), the resistor forming a series resistor during the connection of the first electrical circuit ground (18*a*) to the second electrical circuit ground (18*b*) between the spring contact (16) and the blade contact (28) in the partial region (42) at the contact point (30, 40).

12 Claims, 8 Drawing Sheets

(51) Int. Cl.
*H01R 13/03* (2006.01)
*H01R 13/24* (2006.01)
*H01R 13/6587* (2011.01)

(58) Field of Classification Search
USPC ..... 439/108, 607.05, 620.21, 607.08, 607.1, 439/620.04, 620.08
See application file for complete search history.

(56) References Cited

U.S. PATENT DOCUMENTS

| | | | |
|---|---|---|---|
| 6,129,591 | A | 10/2000 | Czeschka |
| 6,347,962 | B1 | 2/2002 | Kline |
| 6,623,301 | B2 | 9/2003 | Lappoehn |
| 6,976,886 | B2 | 12/2005 | Winings et al. |
| 7,393,218 | B1 | 7/2008 | Pavlovic et al. |
| 2015/0079842 | A1 | 3/2015 | Pao et al. |
| 2017/0229816 | A1 | 8/2017 | Moedinger et al. |

FOREIGN PATENT DOCUMENTS

| | | | |
|---|---|---|---|
| DE | 198 07 713 | A1 | 6/1999 |
| DE | 101 19 695 | A1 | 11/2002 |
| DE | 10 2008 006 340 | A1 | 9/2008 |
| DE | 20 2014 103 633 | U1 | 8/2014 |
| DE | 20 2015 101 883 | U1 | 5/2015 |
| GB | 2 314 697 | A | 1/1998 |
| WO | 00/01041 | A1 | 1/2000 |

* cited by examiner

A - A'

Detail x

PLUG DEVICE

CROSS REFERENCE TO RELATED APPLICATIONS

This application is the National Stage of PCT/DE2016/100169 filed on Apr. 12, 2016, which claims priority under 35 U.S.C. § 119 of German Application No. 10 2015 105 852.9 filed on Apr. 16, 2015, the disclosure of which is incorporated by reference. The international application under PCT article 21(2) was not published in English.

The invention is based on a plug device of the type of the independent claim.

PRIOR ART

Patent application DE 197 27 092 A1 describes a shielded electrical plug connector which contains shield flaps. The shield flaps are arranged in several groups, whereby a plurality of cable routings arise which can be connected to an electrical circuit ground of a circuit board. Due to the specific design, a low-inductance connection of the shielding to the electrical circuit ground is obtained, whereby the effectiveness of the shielding is optimised at higher signal frequencies.

A plug connector having a shaped shield housing emerges from patent application DE 10 2008 006 340 A1. A first stripped cable section is contacted with a clamping element, for example by means of crimping. The corresponding cable section is additionally contacted with a ground bar via a shielding. The ground bar is preferably formed from a material having low electrical impedance in order to enable a control of the ground resistance for the shielding. A conductive plug connector sealing element seals possible leakage current paths for high-frequency disruptions and reduces the impedance of a connection between the shielding and the electrical circuit ground. The connection between the shielding and the electrical circuit ground or the ground bar is hereby achieved with a level of impedance which is as low as possible in order to ensure an effective shielding up to high frequencies.

Patent application DE 42 22 452 A1 describes a shielded plug connector. The relatively thin ground and shield contacts used standing on their edges form a connection which bites into a conductive shield and ground layer of the plugged-in plug connector and therefore enables a stable electrical connection of the shield and ground lines with as low impedance as possible.

A plug connector is described in patent application DE 101 19 695 A1 in which the two plug connection elements of the plug connector are each provided with shield plates. The shield plates lie, in the contacted state of the two plug connection elements, substantially completely one on the other, whereby a low-inductance and overall low-resistance shield signal path is achieved.

Patent specification U.S. Pat. No. 6,976,886 B2 discloses a plug connector in which a high shield effect of the signal-bearing lines against one another and of the plug connector overall is to be achieved by a specific arrangement and alignment of the contact elements guiding signal and contact elements guiding ground potential with respect to one another. The known plug connector is specifically suitable for high-frequency signals, wherein the arrangement of the contact elements guiding signal and contact elements guiding ground potential is additionally provided specifically to achieve a specific level of characteristic impedance.

In patent application DE 198 07 713 A1, a plug connector is described which contains a large number of contact elements.

The known plug connector is provided to establish plug connections between backplanes and plug-in cards, wherein, in the specific exemplary embodiment, plug connections between backplanes and plug-in cards of so-called compact PCI systems are established.

A plug connector and a component emerge from utility model specification DE 20 2014 103 633 U1, wherein the plug connector has contact elements which are divided into at least one signal contact element and at least one shield contact element. Furthermore, a component that is to be contacted or is already contacted with the plug connector is provided which has an electrical circuit ground. The described plug connector and the component are characterized by an ohmic resistor being provided which connects at least one shield contact element of the plug connector to the electrical circuit ground. The electrical connection of at least one shield contact element of the plug connector to a circuit ground via a resistor instead of a direct electrical connection prevents parasitic fluctuations which influence the signal transfer behaviour via the plug connector disadvantageously and can considerably worsen the signal quality. The resistor acts as a damping resistor.

In the specialist book by Meinke and Gundlach "Taschenbuch für Hochfrequenztechnik" (Pocket book for high-frequency technology), Springer-Verlag 1956, basic concepts of electrical engineering such a capacitance, inductance and characteristic impedance are explained.

The object of the invention is to specify a plug device which has a smooth frequency response or damping course, in particular up to high frequencies or data transfer rates.

The object is solved by the features specified in the independent claim.

ADVANTAGES OF THE INVENTION

The invention is based on a plug device which contains a first plug connector having spring contacts, wherein at least one spring contact is provided for the establishing of an electrical connection between a first and a second electrical circuit ground, and which contains a second plug connector having blade contacts, wherein at least one blade contact is provided for the establishing of the connection of the two electrical circuit grounds. The plug device according to the invention is characterized by an ohmic resistor being provided at least in a partial region at the contact point at which the front end of at least one spring element of a spring contact of the first plug connector is supported on a corresponding blade contact of the second plug connector, said resistor forms a series resistor in the connection of the first electrical circuit ground to the second electrical circuit ground between the spring contact and the blade contact in the partial region at the contact point.

The plug device according to the invention enables the establishing of plug connections of a high quality up to the upper limit of the specified frequency range or the specified data rate range of the plug device, wherein the upper limit can lie at a high frequency of, for example, 30 GHz or at a high data rate of 30 Gbit/s. The plug device according to the invention ensures that only comparably low deviations from the ideal frequency course or damping course up to the upper limit are to be expected.

Without the measures provided according to the invention, the formation of eddy currents in the region of the contact point between spring elements of spring contacts and blade contacts must be expected. The introduction provided according to the invention of an ohmic resistor at least in a partial region of the contact point between a spring element of the spring contact and the blade contact dampens the eddy currents or prevents the occurrence of eddy currents which are responsible for the undesirable parasitic effects in the connection of the electrical circuit grounds of the same potential via the plug device.

The resistor can be provided in a partial region or in several partial regions at the contact point between the spring element of the spring contact and the blade contact. It must be ensured here that a direct galvanic connection between at least one spring element of the spring contact and the blade contact is possible at least in a remaining partial region without resistance, such that a low-resistance connection between the two circuit grounds of the same potential to be connected via the plug device can be established.

Advantageous developments and embodiments of the plug device according to the invention are each the subject matter of dependent claims.

One embodiment provides that the spring contact contains at least one further spring element and that the resistor of the contact pin is allocated between the further spring element and the blade contact corresponding to the further spring element. Here the resistor can be allocated to a partial region of the contact point or alternatively to the entire contact point between the further spring element and the corresponding blade contact. Provided that the resistor is allocated to the entire contact point between the further spring element and the blade contact, the at least one other present spring element of the spring contact establishes the required direct galvanic connection between the circuit grounds to be connected via the plug device.

Purely in principle, the resistor could be implemented as a discrete component, for example as an SMD resistor or as a miniature resistor. According to one embodiment it is provided that the resistor is implemented as a layer. Cermet, carbon, electrically conductive plastic or a metallic layer having a predetermined specific resistance is suitable as a material for the coating.

The coating can be provided either on the blade contact or on the spring element or distributed both on the blade contact and on the spring element of the spring contact.

One embodiment provides that the resistance lies in a range from 20 to 100 Ohm. This range has been proved to be an optimum range by means of tests and by means of calculations.

One embodiment provides that the resistance value of the resistor corresponds to the characteristic impedance of a signal line guided via the plug device, wherein a characteristic impedance of 50 Ohm is frequently provided.

One embodiment of the plug device according to the invention provides that at least two signal contact elements arranged directly adjacent to each other are provided and that the spring contact and the blade contact, via which the electrical circuit grounds are to be connected, are allocated to the two signal contact elements arranged directly adjacent to each other.

One development of this embodiment provides that the transfer of differential signals is provided via the two signal contact elements arranged directly adjacent to each other.

Another embodiment relates to the implementation of the blade contact which is preferably implemented in an L-shaped, such that at least a partial encompassing and shielding of the at least one signal contact element allocated to the ground-guiding blade contact is possible.

Further advantageous developments and embodiments of the plug device according to the invention result from the following description.

BRIEF DESCRIPTION OF THE EXEMPLARY EMBODIMENTS

The exemplary embodiments are explained in more detail by means of the drawings.

Figure 2:
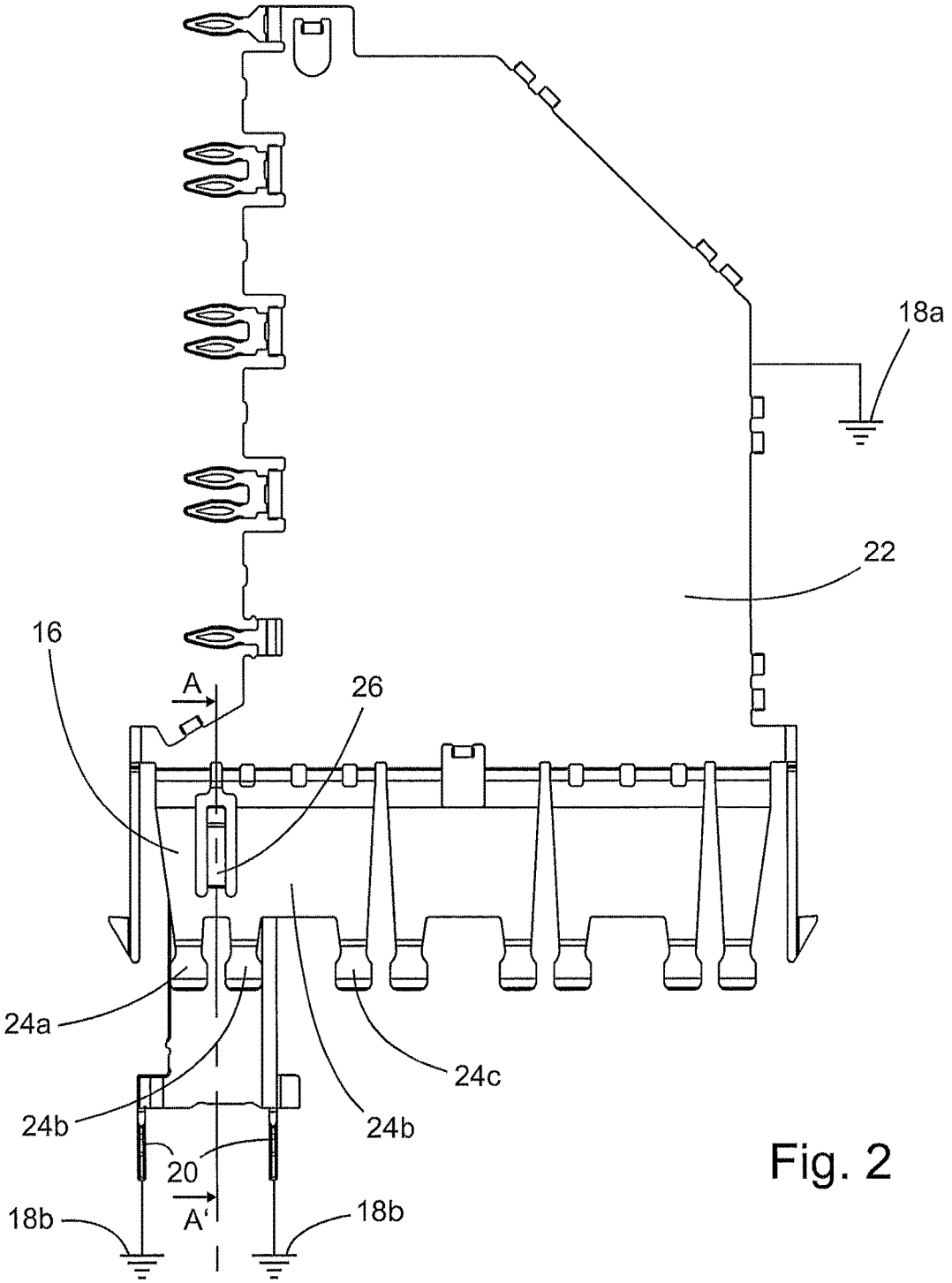
Figure 3:
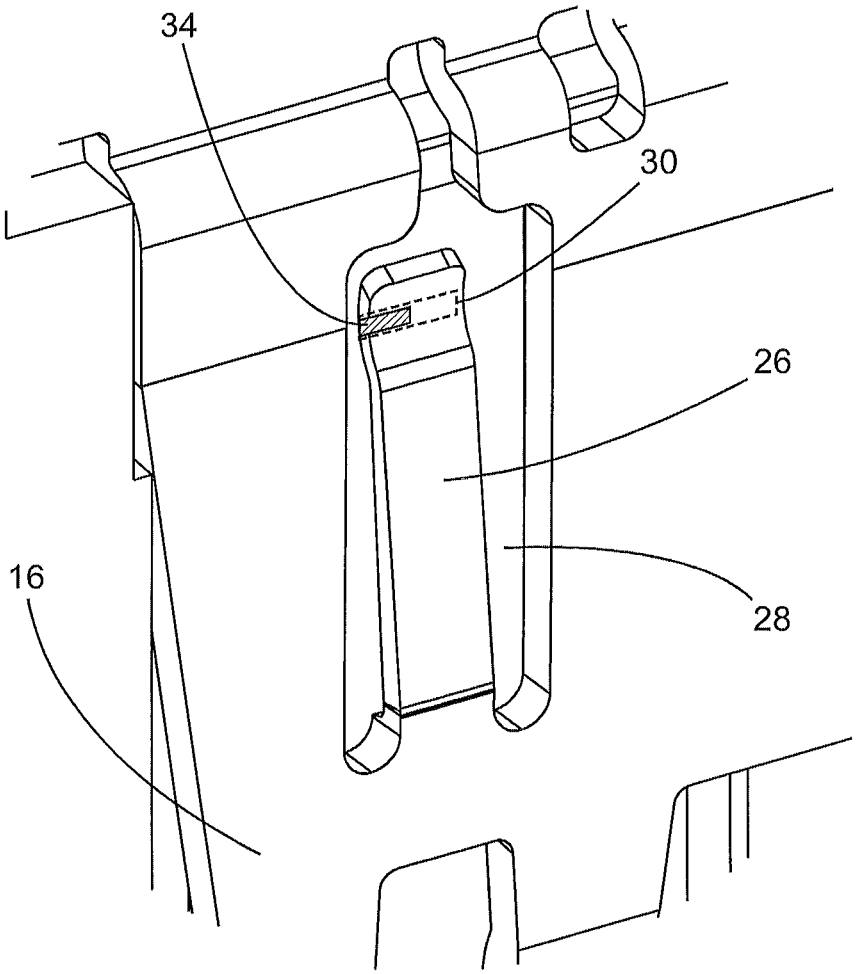
Figure 4:
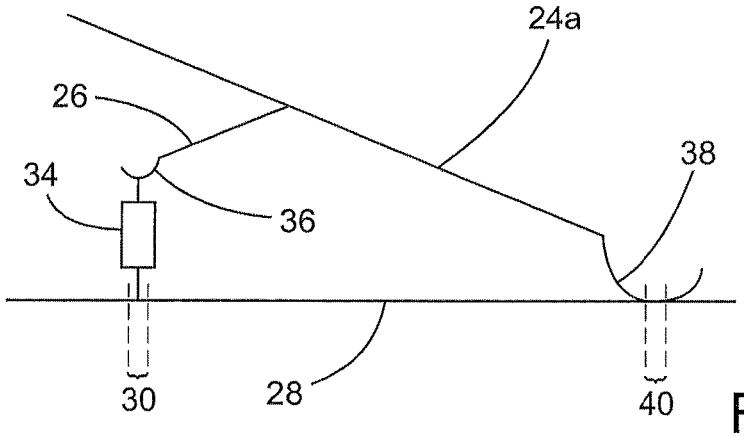
Figure 5:
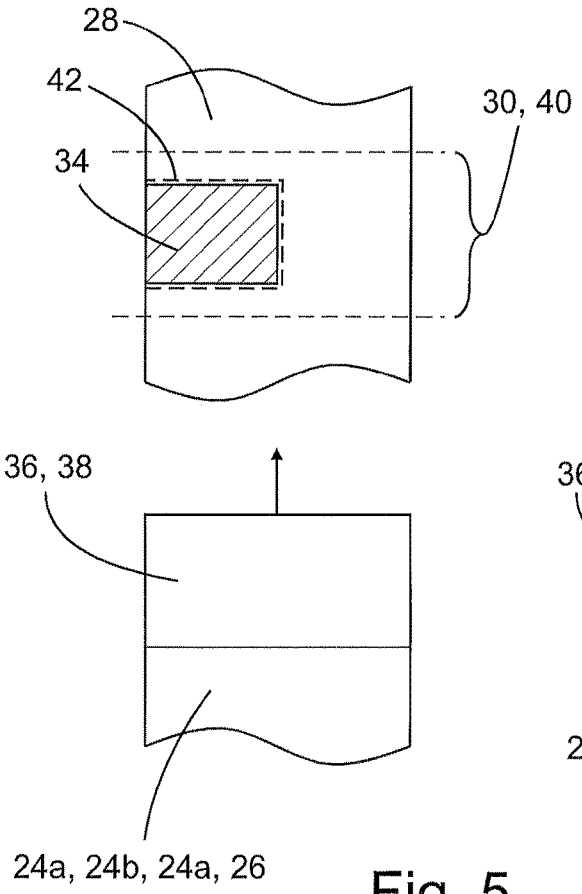
Figure 6:
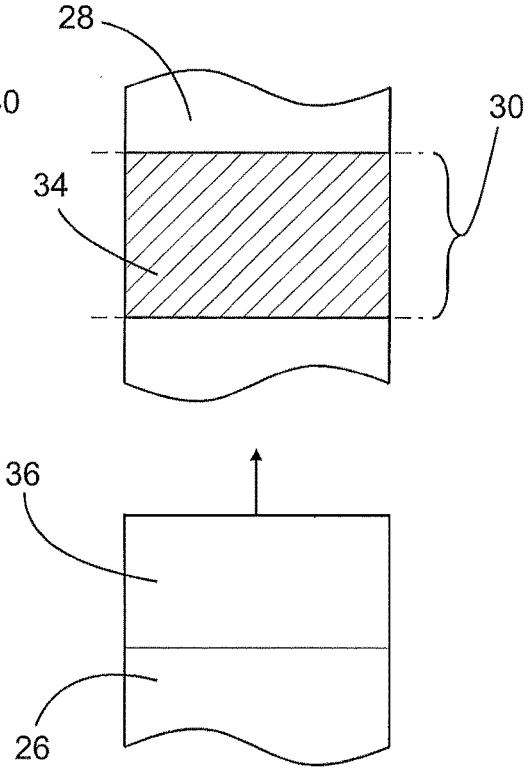
Figure 7:
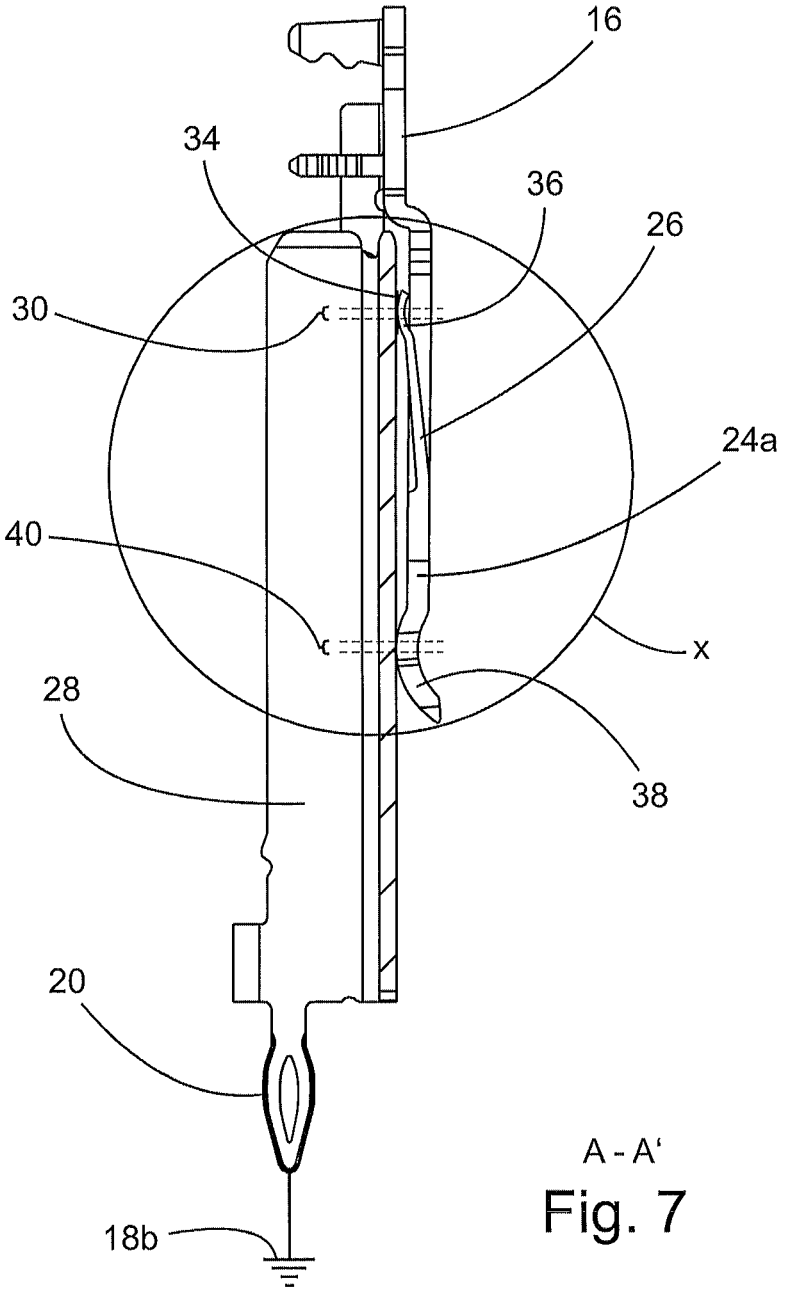
Figure 8:
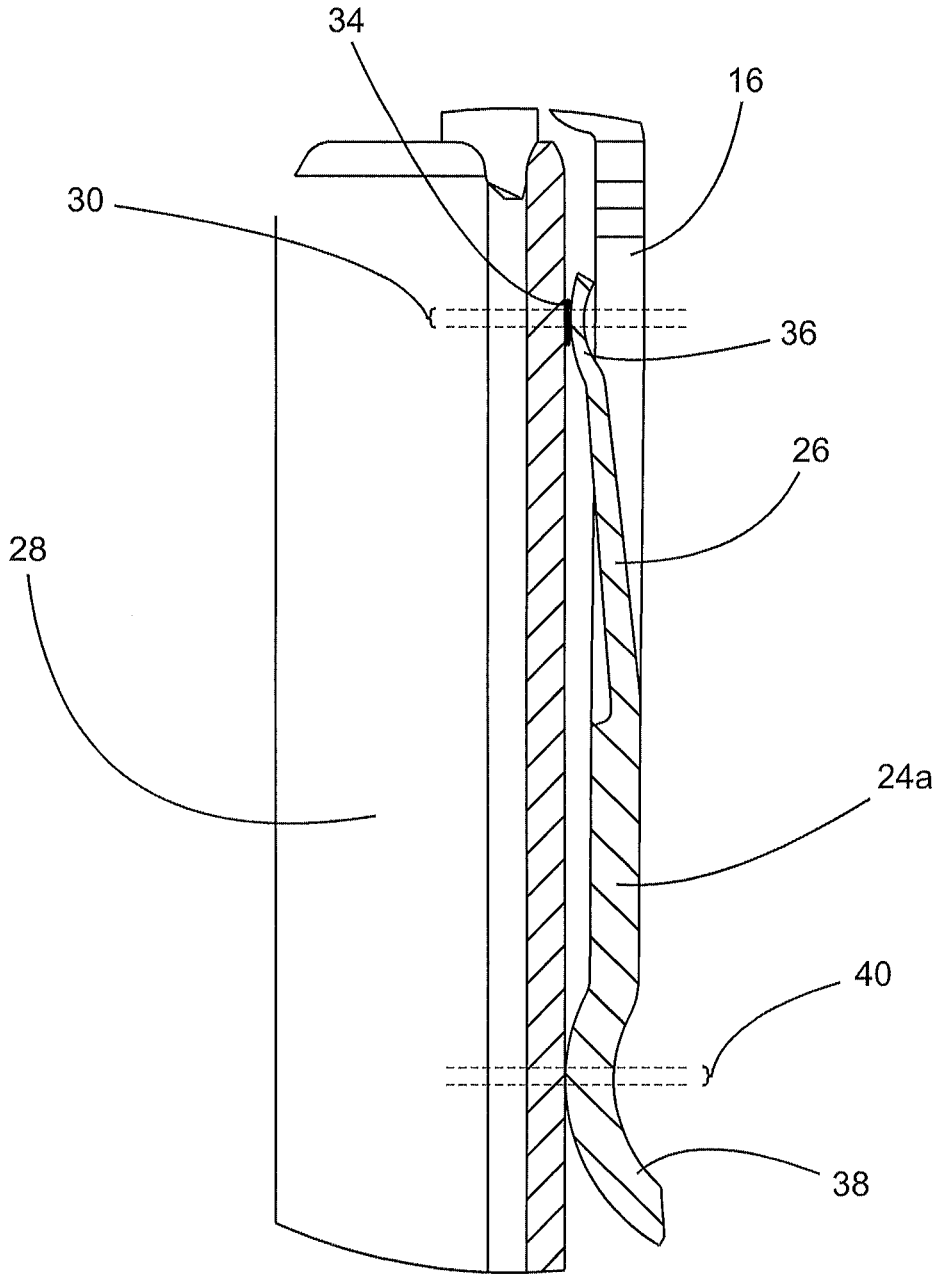
Figure 9:
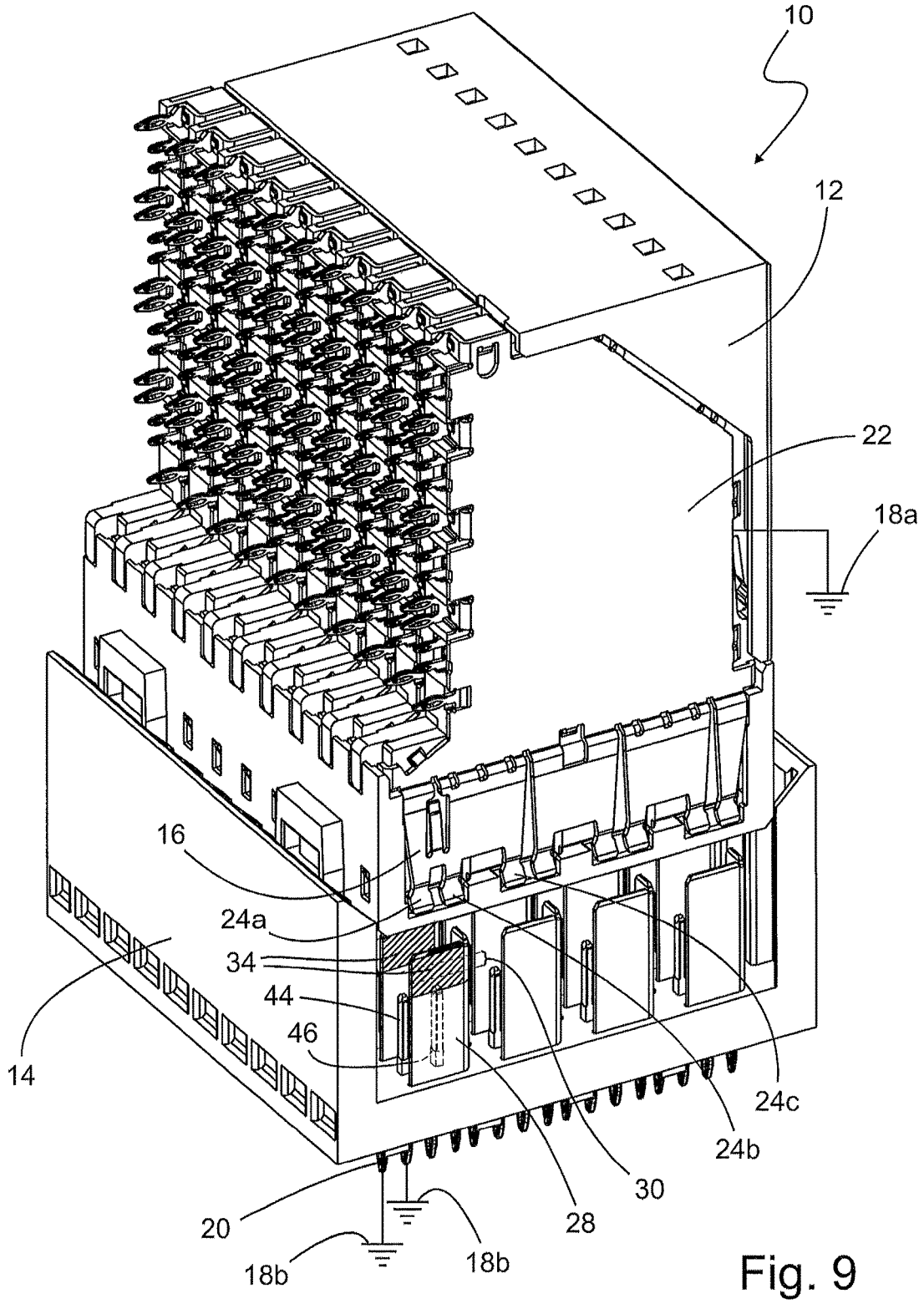
Figure 10:
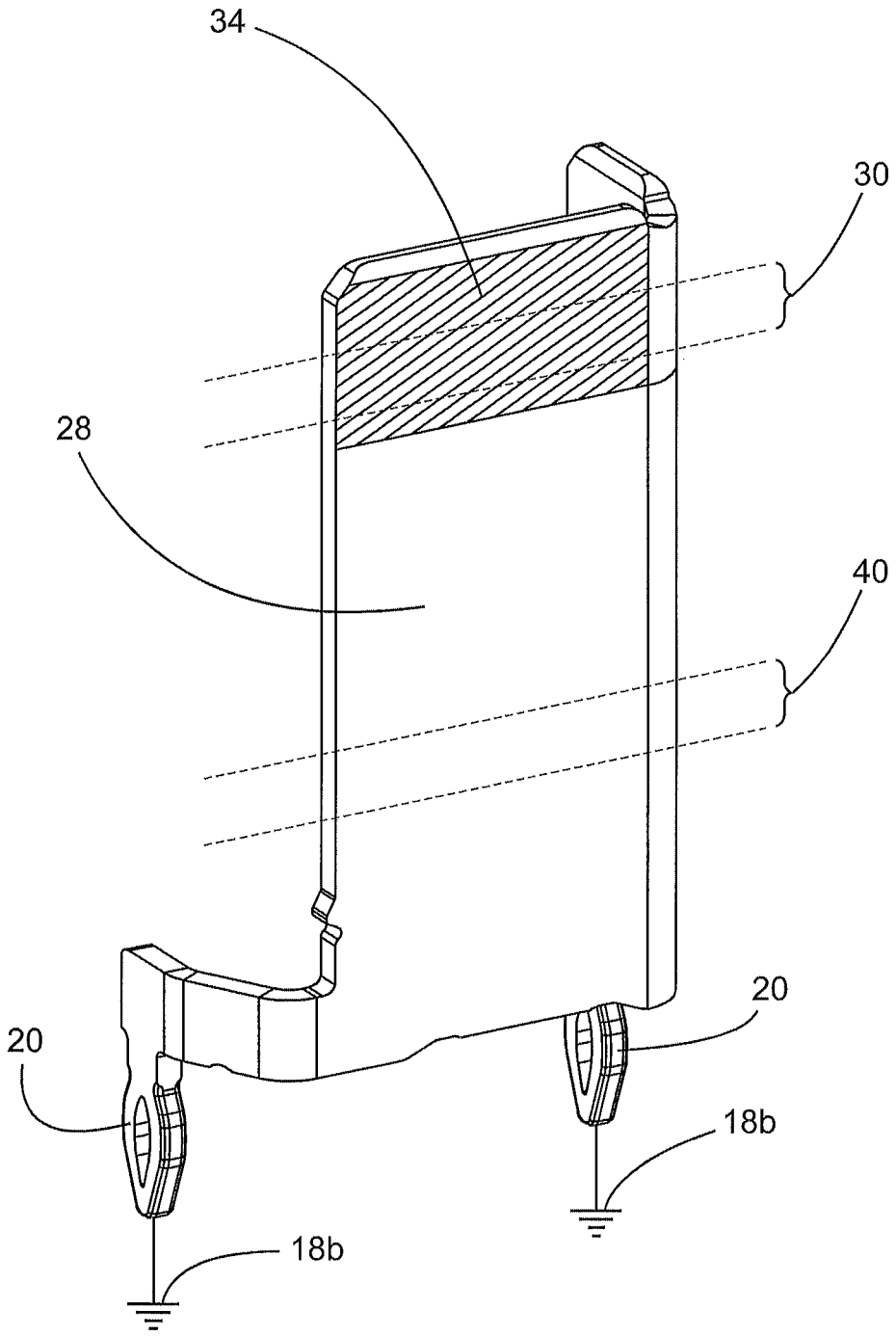

FIG. 1 shows an isometric view of a plug device which contains a first and second plug connector, FIG. 2 shows a top view onto a part of the plug device, FIG. 3 shows an isometric view of a detail of the top view shown in FIG. 2, FIG. 4 shows a schematic depiction of the connection between a contact spring and a contact blade, FIG. 5 shows a contact point between a further spring element and a contact blade or between a spring element and the blade contact before the establishing of the plug connection, FIG. 6 shows a contact point between a further spring element and a blade contact before the establishing of the plug connection, FIG. 7 shows a cross-section through a spring contact and a blade contact along a line of intersection A-A' shown in FIG. 2, FIG. 8 shows a detail of FIG. 7 and FIG. 9 shows an isometric depiction of a plug device and FIG. 10 shows an individual blade contact.

DETAILED DESCRIPTION OF THE EXEMPLARY EMBODIMENTS

FIG. 1 shows an isometric view of a plug device 10 which contains a first plug connector 12 and a second plug connector 14, wherein, in FIG. 1, the plugged-together state of the first and second plug connector 12, 14 is depicted. In the shown exemplary embodiment, the first plug connector 12 is to contain spring contacts 16 and the second plug connector 14 is to contain non-visible blade contacts.

The plug device 10 is, in particular, provided to connect lines, via which signals are to be transferred, the frequency of which lie in a high frequency range of, for example, 1 GHz to 30 GHz. The plug device 10 according to the invention is, in particular, suitable to transfer digital signals, wherein the data rate can lie in a high range of, for example, 1 Gbit/s to 30 Gbit/s. In this frequency range or data rate range, an electrical ground connection guided via the plug device 10 is of particular significance. It must be considered here that, in the case of an effective relative dielectric constant of the used plastics for the plug device 10, the dimensions of the plug device 10 or the dimensions of one of the plug connectors 12, 14 already lies at the upper frequency limit or the upper data rate in the range of a wavelength of the signals to be transferred.

As well as the connection of the signal lines, in particular the ground connection also determines the transfer quality of the plug device 10 which, for example, can be specified by the signal damping and phase rotation or generally by the S-parameters, depending respectively on the frequency. The ground connection connects a first electrical circuit ground 18*a* of a first component, with which the first plug connector 12 is contacted, and the second electrical circuit ground 18*b* of a second component, with which the second plug connector 14 is connected. The connection occurs, for example, via solder pins or press-in contact elements 20.

The first plug connector 12 preferably contains at least one shield plate 22 which is connected to the first electrical circuit ground 18*a* of the first component. The first plug connector 12 can furthermore contain at least one contact element, though preferably a plurality of contact elements which are connected to the electrical circuit ground 18*a* of the first component. The shield plate 22 is therefore to be used only by way of example to explain the plug device 10 according to the invention. The shield plate 22 is connected in an electrically conductive manner via at least one spring contact 16 to a corresponding blade contact, which is not visible in FIG. 1, of the second plug connector 14 in the plugged state of the plug device 10. In the shown exemplary embodiment, a spring contact 16, exemplarily, has three spring elements 24*a*, 24*b*, 24*c*. The spring contact 16 can additionally contain a further spring element 26.

FIG. 2 shows a top view onto the shield plate 22. The parts shown in FIG. 2 which accord with the parts shown in FIG. 1 are each referred to with the same reference numerals. This agreement also applies to the following figures.

In FIG. 2, the plugged state of the plug device 10 is depicted in which two spring elements 24*a*, 24*b* are to be contacted with a blade contact 28, wherein the blade contact 28 establishes the ground connection for the second electrical circuit ground 18*b* of the second component via the solder pins 20. The further spring element 26 also establishes a ground connection between the spring contact 16 and the blade contact 28.

FIG. 3 shows an isometric view of a detail of FIG. 1 or of FIG. 2 in the region of the further spring element 26. The contact point 30 between the further spring element 26 and the blade contact 28 is recorded with a dashed line. Furthermore, an ohmic resistor 34 is recorded with hatching, said ohmic resistor being provided in at least one partial region of the contact point 30.

The resistor 34 corresponds to a series resistor at which the further spring element 26 is connected at least partially to the blade contact 28 via the series resistor.

It is determined by means of measurements that, in the case of the high signal frequencies already mentioned or corresponding high data rates, unsmooth damping courses can occur during the signal transfer via the plug device 10. Both amplitude drops and amplitude peaks have been determined depending on the frequency. This behaviour can be explained by the formation of eddy currents in the region of the contact point 30 between the spring contact 16 and the blade contact 28. The eddy currents can lead to resonance effects which cause both a signal damping and a signal increase depending on the frequency.

It has been proved by means of experiments and by means of calculation that the introduction of an ohmic resistor 34 at least in a partial region of the contact point 30 between a spring element 24*a*, 24*b* or of the further spring element 26 and the blade contact 28 dampens eddy currents or completely prevents the occurrence thereof. With the elimination of eddy currents, smooth signal damping is achieved depending on the frequency up to the upper specified frequency limit or the upper specified data rate limit of the plug device 10.

FIG. 4 shows a schematic depiction of the connection between a spring contact 16 and the blade contact 28, for example of the first spring element 24*a* and of the further spring element 26.

The front end 36 of the further spring element 26 is connected electrically to the blade contact 28 in at least one partial region of the contact point 30 via the resistor 34. The front end 38 of the spring element 24*a* also has a contact point 40 via which the electrical connection to the blade contact 28 is established. Purely in principle, a resistor can be provided, at least in a partial region, even at the contact point 40 between the front end 38 of the spring element 24*a* and the blade contact 28.

FIG. 5 shows the contact point 30 between the further spring element 26 and the blade contact 28 and the contact point 40 between the spring element 24*a* and the blade contact 28 before the establishing of the plug connection, in which the front end 36 of the further spring element 26 and the front end 38 of the spring element 24*a* is pushed over the blade contact 28. The resistor 34 is provided in a partial region 42 of the contact point 30, 40, wherein several partial regions 42 can also be provided.

Purely in principle, the resistor 34 can be implemented as a discrete component, for example as an SMD resistor or a miniature resistor which can be provided at the front end 36 of the further spring element 26 or at the front end 38 of the spring element 24*a* or in the region of the contact point 30, 40 of the blade contact 28, wherein a distribution of the resistor 34 is also conceivable in which a partial resistor is provided on the front end 36 of the further spring element 26 or on the front end 38 of the spring element 24*a* and a second partial resistor is provided on the blade contact 28.

Preferably, the resistor 34, however, is implemented by means of a layer which can again likewise be distributed on a layer on the front end 36 of the further spring element 26 or on the front end 38 of the spring element 24*a* and of a layer on the blade contact 28. Preferably, the layer of the resistor 34 is provided in the region of the contact point 30, 40 on the blade contact 28.

For the coating, a resistance material can be used which is used in potentiometers. Cermet, which refers to a composite material made from ceramic materials in a metallic matrix, is, for example, suitable. Cermet is characterized by a high wear resistance, such that plug devices 10 can be produced which are designed for many plug procedures. The resistor 34 can also be implemented from a carbon layer, a metallic layer having a predetermined specific resistance or a conductive plastic having a predetermined specific resistance.

It has been proved by means of tests and by means of calculation that the resistance value of the resistor 34 preferably lies in the range between 20 and 100 Ohm. According to one specific exemplary embodiment, the resistance value of the resistor 34 can amount to at least approximately 50 Ohm. In particular, a resistance value of the resistor 34 which corresponds to the characteristic impedance of the signal lines guided via the plug device 10 is suitable. Details for the determination of the capacitance per unit of length and of the inductance per unit of length of the plug device 10 as well as the characteristic impedance can be gleaned from the specialist book specified at the beginning by Meinke and Gundlach, in particular pages 14, 18 and 165.

FIG. 6 shows the contact point 30 between the further spring element 26 and the blade contact 28 before the establishing of the plug connection in which the front end 36 of the further spring element 26 is pushed over the blade contact 28. In this exemplary embodiment, the resistor 34 not only covers at least one partial region 42 of the contact point 30, but the overall contact point 30. This exemplary embodiment can be provided if the spring contact 16 has at least two spring elements 24*a*, 24*b*, 24*c*, 26, because it must be ensured that at least one spring element 24*a*, 24*b*, 24*c*, 26 of a spring contact 16 can establish a galvanic connection between the spring contact 16 and the blade contact 28 without an additional resistor 34.

FIG. 7 shows a cross-section through the spring contact 16 and the blade contact 28 along a line A-A' shown in FIG. 2. In the shown exemplary embodiment, the resistor 34 is to be provided at the contact point 30 between the front end 36 of the further spring element 26 and the blade contact 28, while the front end 38 of the spring element 24*a* is to be connected directly to the blade contact 28 at the contact point 40 without a resistor in the plugged state of the plug device 10. In the shown exemplary embodiment, the blade contact 28 is implemented as an L-shaped blade contact 28.

FIG. 8 shows the detail X from FIG. 7, from which the contact points 30, 40 between the front end 38 of the further spring element 26 and the blade contact 28 or the front end 38 of the spring element 24*a* and the blade contact 28 as well as the resistor 34 clearly emerge.

FIG. 9 shows an isometric depiction of the plug device 10 in which the entire front region of the blade contact 28 is coated with the resistor 34 according to one exemplary embodiment. A position of the first plug connector 12 and of the second plug connector 14 with respect to each other before the plugging together of the plug device 10 is depicted. In this exemplary embodiment, no resistor is provided at the contact point 40 which is not recorded, between the spring elements 24*a*, 24*b* and the blade contact 28.

According to the shown exemplary embodiment, two signal contact elements 44, 46 are to be allocated to the L-shaped blade contact 28, said signal contact elements being shielded by the L-shaped blade contact 28. The plug device 10 can preferably be used to connect signal-bearing lines which contain at least one pair of signal-bearing lines which comprise at least one, preferably a plurality of two signal contact elements 44, 46 arranged to be directly adjacent. The signal contact element pair is preferably used to connect differential signals. Such a differential signal has, for example, a positive level with regard to a central level at the one signal contact element 44 and, simultaneously, a negative level at the adjacent signal contact element 46. The levels alternate in a push-pull manner with the signal frequency. In this embodiment, an L-shaped implementation of the blade contact 28 is particularly advantageous which surrounds the two contact elements 44, 46 at least partially.

FIG. 10 shows an individual blade contact 28 which is to establish the connection for the second electrical circuit ground 18*b* of the second component using two solder pins 20, according to the exemplary embodiment, wherein the blade contact 28 is implemented again as an L-shaped blade contact 28. It emerges from FIG. 10 that the layer of the resistor 34 is provided in the entire region of the front end of the blade contact 28 which is larger than the contact point 30. The shown exemplary embodiments were based on an L-shaped blade contact 28. Naturally, the blade contacts 28 can be implemented equally and as circular or, for example, square pins. The spring elements 24*a*, 24*b*, 24*c*, 26, corresponding to this, of the spring contacts 16 can be implemented correspondingly as circle segments or for example as rectangular segments.

The invention claimed is:

1. Plug device which contains a first plug connector having spring contacts, wherein at least one spring contact is provided for the establishing of an electrical connection between a first and a second electrical circuit ground, and which contains a second plug connector having blade contacts, wherein at least one blade contact is provided for the establishing of the connection of the electrical circuit grounds, wherein an ohmic resistor is provided at least in one partial region at the contact point at which the front end of at least one spring element of a spring contact of the first plug connector is borne on a blade contact of the second plug connector, said resistor forming a series resistor during the connection of the first electrical circuit ground to the second electrical circuit ground between the spring contact and the blade contact in the partial region at the contact point, wherein the spring contact contains at least one further spring element and wherein the resistor is allocated to the contact point between the further spring element and the blade contact corresponding to the further spring element.

2. Plug device according to claim 1, wherein the resistor is allocated to a partial region or to the entire contact point between the further spring element and the corresponding blade contact.

3. Plug device according to claim 1, wherein the resistor is implemented as a layer.

4. Plug device according to claim 3, wherein cermet, carbon, electrically conductive plastic or a metal layer having a predetermined specific resistance is provided as the material for the layer.

5. Plug device according to claim 3, wherein the layer is provided on the blade contact.

6. Plug device according to claim 1, wherein the resistor has a resistance value of 20-100 Ohm.

7. Plug device according to claim 1, wherein the resistance value of the resistor amounts to at least approximately 50 Ohm.

8. Plug device according to claim 1, wherein the resistance value of the resistor corresponds to the characteristic impedance of a signal line guided via the plug device.

9. Plug device according to claim 1, wherein the blade contact is implemented to be L-shaped.

10. Plug device which contains a first plug connector having spring contacts, wherein at least one spring contact is provided for the establishing of an electrical connection between a first and a second electrical circuit ground, and which contains a second plug connector having blade contacts, wherein at least one blade contact is provided for the establishing of the connection of the electrical circuit grounds, wherein an ohmic resistor is provided at least in one partial region at the contact point at which the front end of at least one spring element of a spring contact of the first plug connector is borne on a blade contact of the second plug connector, said resistor forming a series resistor during the connection of the first electrical circuit ground to the second electrical circuit ground between the spring contact and the blade contact in the partial region at the contact point, wherein the resistor is implemented as a layer provided on the spring element.

11. Plug device which contains a first plug connector having spring contacts, wherein at least one spring contact is provided for the establishing of an electrical connection between a first and a second electrical circuit ground, and which contains a second plug connector having blade contacts, wherein at least one blade contact is provided for the establishing of the connection of the electrical circuit grounds, wherein an ohmic resistor is provided at least in one partial region at the contact point at which the front end of at least one spring element of a spring contact of the first plug connector is borne on a blade contact of the second plug connector, said resistor forming a series resistor during the connection of the first electrical circuit ground to the second electrical circuit ground between the spring contact and the blade contact in the partial region at the contact point, wherein at least two signal contact elements which are arranged directly adjacently to each other are provided and wherein the spring contact and the blade contact via which the two electrical circuit grounds are connected to each other are allocated to the two signal contact elements which are arranged directly adjacently to each other.

12. Plug device according to claim 11, wherein a transfer of differential signals is provided via the two signal contact elements arranged directly adjacently to each other.

* * * * *